United States Patent [19]

Stedman et al.

[11] Patent Number: 5,043,047

[45] Date of Patent: Aug. 27, 1991

[54] ALUMINUM SMELTING CELLS

[75] Inventors: Ian G. Stedman, Norwood; Geoffrey J. Houston, Carnegie; Raymond W. Shaw, North Balwyn; Drago D. Juric, Bulleen, all of Australia

[73] Assignee: Comalco Aluminum Limited, Melbourne, Australia

[21] Appl. No.: 481,847

[22] Filed: Feb. 20, 1990

[30] Foreign Application Priority Data

Feb. 20, 1989 [AU] Australia ..... PJ2826

[51] Int. Cl.[5] ..... C25C 3/06; C25C 3/00

[52] U.S. Cl. ..... 204/67; 704/243 R

[58] Field of Search ..... 204/243 R, 245

[56] References Cited

U.S. PATENT DOCUMENTS

| | | | |
|---|---|---|---|
| 3,067,124 | 12/1962 | Pava | 204/243 R |
| 3,501,386 | 3/1970 | Johnson | 204/67 |
| 4,333,813 | 6/1982 | Kaplan et al. | 204/243 R |
| 4,405,433 | 9/1983 | Payne | 204/243 R |
| 4,602,990 | 7/1986 | Boxall et al. | 204/243 R |

FOREIGN PATENT DOCUMENTS

WO84/03308 8/1984 PCT Int'l Appl. .

*Primary Examiner*—John F. Niebling
*Assistant Examiner*—Caroline Koestner
*Attorney, Agent, or Firm*—Kenyon & Kenyon

[57] ABSTRACT

An aluminum smelting cell comprising a cathode having an active upper surface, a plurality of anodes each having a lower surface spaced from the upper surface of the cathode, said cathode upper surface being sloped at an acute angle in a primary or longitudinal direction of each anode, and being formed with pairs of oppositely sloped surfaces extending in a transverse or secondary direction under each anode to cause complementary shaping of the lower anode surfaces to reduce the migration of bubbles between the anode and cathode along the anode surfaces in said primary or longitudinal direction to thereby reduce the path length of said bubbles whereby the turbulence caused by coalesced bubble disengagement from the bath electrolyte is significantly reduced while maintaining adequate bath circulation between the anode and cathode.

41 Claims, 11 Drawing Sheets

| SLOPE | $i_D$ A/cm² | ΔV (VOLTS) | VOLTAGE SAVINGS |
|---|---|---|---|
| 8° | 1.3<br>0.68 | 0.53<br>0.23 | 100%<br>100% |
| 4° | 1.3<br>0.68 | 0.46<br>0.18 | 87%<br>78% |

| CASE | CATHODE SHAPE | ACD | HEIGHT OF CATHODE PROTRUSION (h) (mm) | ANGLE OF CATHODE PROTRUSION (γ) DEGREES | COMMENTS |
|---|---|---|---|---|---|
| 1 |   | 15 | 30 | 15 | ANODE BURN PROFILE GOOD. WELL ROUNDED |
| 2 |   | 25 | 30 | 15 | AS ABOVE |
| 3 |   | 40 | 30 | 15 | AS ABOVE |
| 4 |   | 40 | 20 | 15 | LOWER HEIGHT OF CATHODE PROTRUSION ANODE SHAPE GOOD AND EQUIVALENT TO CASES 1-3 |

ALUMINUM SMELTING CELLS

FIELD OF THE INVENTION

This invention relates to improvement in aluminium smelting cells and more particularly to improved anode and cathode constructions aimed at reducing turbulence in the cell while improving the discharge of anode gases from the cell.

BACKGROUND OF THE INVENTION

A commonly utilized electrolytic cell for the manufacture of aluminium is of the classic Hall-Heroult design, utilizing carbon anodes and a substantially flat carbon-lined bottom which functions as part of the cathode system. An electrolyte is used in the production of aluminium by electrolytic reduction of alumina, which electrolyte consists primarily of molten cryolite with dissolved alumina, and which may contain other materials such as fluospar, aluminium fluoride, and materials such as fluoride salts. Molten aluminium resulting from the reduction of alumina is most frequently permitted to accumulate in the bottom of the receptacle forming the electrolytic cell, as a metal pad or pool over the carbon-lined bottom, thus forming a liquid metal cathode. Carbon anodes extending into the receptacle, and contracting the molten electrolyte, are adjusted relative to the liquid metal cathode. Current collector bars, such as steel are frequently embedded in the carbon-lined cell bottom, and complete the connection to the cathodic system.

While the design and size of Hall-Heroult electrolytic cells vary, all have a relatively low energy efficiency, ranging from about 35 to 45 percent depending upon cell geometry and mode of operation. Thus, while the theoretical power requirement to produce one kilogram of aluminium is about 6.27 Kilowatt hours (KWh), in practice power usage ranges from 13.2 to 18.7 KWh/Kg, with an industry average of about 16.5 KWh/Kg. A large proportion of this discrepancy from theoretical energy consumption is the result of the voltage drop of the electrolyte between the anode and cathode.

As a result of the above, much study has gone into reduction of the anode-cathode distance (ACD). However, because the molten aluminium pad which serves as the cell cathode can become irregular and variable in thickness due to electromagnetic effects and bath circulation, past practice has required that the ACD be kept at a safe 3.5 to 6 cm to ensure relatively high current efficiencies and to prevent direct shorting between the anode and the metal pad. Such gap distances result in voltage drops from 1.4 to 2.7 volts, which is in addition to the energy required for the electrochemical reaction itself (2.1 volts, based upon enthalpy and free energy calculations). Accordingly, much effort has been directed to developing a more stable aluminium pad, so as to reduce the ACD to less than 3.5 cm, with attendant energy savings.

Refractory hard materials (RHM), such as titanium diboride, have been under study for quite some time for use as cathode surfaces in the form of tiles, but until recently, adherent RHM tiles or surface coatings have not been available. Titanium diboride is known to be conductive, as well as possessing the characteristic of being wetted by molten aluminium, thus permitting formation of very thin aluminium films.

The use of a very thin aluminium film draining down an inclined cathode covered with an RHM surface, to replace the unstable molten aluminium pad of the prior art, has been suggested as a means to reduce the ACD, thus improving efficiency, and reducing voltage drop. However, attempts to achieve such goals in the past have failed due to the inadequacy of available RHM surfaces, and the inability to overcome the difficulty of providing a sufficient supply of dissolved alumina to the narrowed ACD (as small as 1.5 cm). Thus, problems of alumina starvation occur at minimal ACD, including excessive and persistant anode effects. Overfeeding alumina to prevent these problems has resulted in deposits of sludge (mucking), which can clog the cell and restrain its operation.

U.S. Pat. No. 4,602,990 by Boxall et al. discloses a design for a drained cathode cell in which the cathode slope and inter anode distances are arranged so that the balance between buoyancy-generated bubble forces from the inclination and the flow resistance will result in a net motion of the bath to provide the required alumina supply. The rate of flow in the bath circulation loop through the anode-cathode gap (ACD), a bath replenishment zone (a channel where alumina is added to the bath) and return channel between the anodes is primarily controlled by the anode-cathode slope, the ACD gap and the design of the space between adjacent anodes. This patent provides the design specifications to ensure sufficient flow of the bath through the ACD gap to transport an adequate supply of dissolved alumina for the electrolysis reaction within the same ACD gap. In an aluminium reduction cell with sloped anode and cathode faces, the gas formed at the anode face will travel upward along the inclination. In turn, these anode gases will drive the bath in the ACD gap in the same direction. This action generates the forces required to produce the desired bath motion in the electrolysis cell operating at a reduced ACD spacing.

A number of cell designs, such as in the Kaiser-DOE sloping TiB2 cathode tests reported under Contract DE-ACO3-76CS40215, and as used in other published reports and patents including Boxall et al. have not achieved the expected voltage reduction corresponding to the reduction in the ACD gap. This problem is common to a number of different RHM cathode designs incorporating plates, cylinders, vertical and horizontal rods, inverted cups and a packed bed. The RHM cathode slope at a 15 k Amp pilot cell in the Kaiser DOE project was increased from 2 degrees to 5 degrees from horizontal in an attempt to provide more effective gas evolution and electrolyte mixing in the ACD gap. Halving the ACD in the 2 degree cathode slope cell gave a 35% reduction in bath resistance instead of the theoretical 50% reduction. This implies that the effective bath resistivity at the lower ACD was about 30% higher than at the higher ACD. Kaiser ascribed the increased bath resistivity at low ACD's primarily to an increasing void fraction of anode gas as the ACD is decreased. Changing to the 5 degree cathode slope cell did not improve on this detrimental increase in bath resistivity at reduced ACD's.

During the operation of all drained RHM cathode cells, the anode face shape will burn to conform to the shape of the underlying rigid cathode face. This phenomena is referred to as "anode shaping". A similar effect is observed in conventional metal pad aluminium reduction cells where the cell magnetics produce a stable heave in the metal pad surface.

In operation of an aluminium smelting cell, gas bubbles, primarily carbon dioxide, develop on the carbon anode faces as a result of the electrolysis reaction taking place within the cell. These bubbles must find their way out of the ACD gap and then be discharged from the bath electrolyte. In a conventional cell with horizontal anode and cathode faces, the gas bubbles will move in a somewhat random fashion and are eventually discharged along the nearest anode edge. In a drained RHM cathode cell the inclined anode face results in a predominant movement of the gas bubbles upwards along the length of the anode slope. This directed flow of the anode gas bubbles produces the desired bath flow in the ACD. However, the distance between the position of initial formation of the gas bubbles and the exit point from the ACD gap may be quite lengthy and the bubble volume will lend to accumulate with distance under the anode. At reduced ACD's these large gas bubbles increase the bath resistivity and may protrude through the ACD gap to contact or be in close proximity to the aluminium wetted cathode surface. Since drained RHM cathode cells result in a thin film of aluminium wetting the RHM cathode surface, rather than the deeper molten aluminium 'pad' characteristic of conventional cells, any disturbance of the film, such as may be caused by undesirable bubble accumulation, will result in a degradation of the performance of the cell as well as redissolution of aluminum into the bath.

Houston et al. (Light Metals pp 641-645, 1988) report a significant increase in the effective bath resistivity for a commercial scale drained cathode cell operating at ACD values down to 1 cm. Since current efficiencies for full scale drained cathode cells have not been reported, it is unknown if this close proximity or contact of the oxidizing anode gases with drained cathode will reduce current efficiency and/or cause damage to the wetted RHM surfaces. Serious loss of current efficiency is observed in conventional aluminium smelting cells when operated at reduced ACD values. Furthermore, bath circulation rates in such drained cathode cells have been found to be somewhat higher than desired, resulting in an undesirable increase in turbulence at the upper end of each anode and creating conditions having the potential to cause further disturbance of the aluminium film and erosion of the cathode coating at these points.

Also included in the patent literature is U.S. Pat. No. 3,501,386 Johnson. The essence of this disclosure is the provision of anodes with shaped lower surfaces in an otherwise standard cell having a planar cathode to expedite the removal of gases and minimize recombination with the metal. Gases are vented towards the shortest escape distance from under the anode. In the process of escaping, the bubble lift action produces an induced electrolyte flow in preferred directions, which assists with bubble removal and electrolyte circulation.

Johnson suggests that the shaping of the anode can be achieved by making the anodes less dense or of greater electrical conductivity at specific locations. Workers familiar with anode manufacture indicate the likelihood of significant practical difficulties in achieving appropriate density variations: mismatching at the boundary between the different regions is likely to produce strength and thermal shock problems, quite apart from the additional processing steps needed to engineer these special anodes. In addition, anode fabrication of this type would be likely to be extremely expensive.

Johnson alternatively suggests that tilting and burning of the anode groupings will provide a means of maintaining a sloped surface underneath the anode. As an initially-sloped anode surface is levelled by burning to the flat cathode profile, so the anode group is tilted in the opposite direction to re-expose a newly-sloped surface. The process is repeated as frequently as every 1-4 hours.

Whilst in principle this approach may seem to be workable, the following factors indicate that it would be largely impractical or unworkable:

Aluminium reduction in cells operating near 1000° C. requires that a frozen crust of electrolyte, together with a loose layer of crushed bath or alumina, be formed on the top of the cell to reduce heat losses in order to maintain a strict heat balance (a critical issue), to restrict the loss of volatile components from the electrolyte, and to provide some oxidation protection for the carbon anodes. The continual tilting of the anode group will produce extensive cracking of the crust layer and lead to large amounts of loose cover falling into the bath. The former effect will degrade the insulating capacity of the frozen crust, requiring the input of more energy to the cell to maintain its heat balance and thus decreasing the overall energy efficiency contrary to a main claim of the inventor. The second effect will produce excessive solid deposits (sludge) on the base of the cell which are notoriously difficult to remove and also require extra energy input. The solid deposits also disrupt the equilibrium electromagnetic fields in the cell, thus disturbing the mobile metal pad and increasing the likelihood for metal fog formation and a consequential lowering of current efficiency, contrary to the claims for improved current efficiency.

Very high electrical currents are used for aluminium electrolysis (ca 150-300,000 Amps at anodic current densities of 0.7-1.0 A/cm$^2$). The electromagnetic effects caused by the interaction of the electrical and induced magnetic fields generate an equilibrium metal pad profile and degree of metal movement. The equilibrium profile of the metal surface is set by the interaction of the whole electromagnetic force field. Cells are specifically designed with great care to achieve a balance in the forces so that metal circulation and wave formation are kept to an acceptable level.

The continual tilting of the anode group will cause repeated changes to the electromagnetic force field with a consequent destabilization of the equilibrium metal pad profile, leading to an increase in the motion of the metal surface. Furthermore the tilting action will act to concentrate the applied current along one edge of the anode, thus dramatically increasing the local current intensity which in turn, leads to a localized influence on that bit of metal closest to the anode edge, producing a changing and asymmetric force on the metal, destroying the equilibrium metal profile. These combined influences increase the overall likelihood of metal fog formation and back reaction, contrary to the claims. The very changeability of the force fields produces an environment of uncertainty regarding the behaviour of the metal pad, which no operator would choose to accept.

The tilting motion brings one edge of the anode much closer to the metal pad surface for a time. The normal practice in conventional aluminium reduction cells is to maintain a good distance between the anodes and the mobile metal pool to avoid contact with the waves that often exist at the metal surface. During tilting, the change for contact is increased with a resultant unstable cell voltage and intermittent short circuiting, leading to poor current and energy efficiency. To avoid this situation, the anode cathode distance would need to be increased which in turn would increase the cell voltage and diminish the stated voltage benefit.

It would seem, from the absence of working examples in the Johnson patent, doubtful that even a pilot scale cell has been operated according to this invention. In the 20 years since the patent has been published, there has been no record of its commercial use, which may be regarded as a good indication of its fundamental unworkability.

In the U.S. Pat. No. 4,405,433 to Payne, there is provided a very steeply sloping anode and cathode structures, with slopes of around 60° to 85° (i.e. nearly vertical). The aim of the invention is to provide for enhanced bubble removal from the ACD and to thereby achieve a decrease in the bubble voltage component. A second aim is to provide a means for the ready replacement of the fragile and easily damaged RHM materials.

The disadvantages of this patent are as follows:

Payne specifically states (column 4, lines 27–43) that bubble problems occur in drained cathode cells employing low slops and that steep slopes are needed to enhance the bubble release. The results achieved by the present invention, as detailed below, show that improved cell voltages can be achieved even with shallow slopes at low ACD's.

It is necessary to run the Payne cell with a liquid bath surface (i.e. crust free) to enable the pivoting anodes to move. This is undesirable because of the splashing of the molten bath and the loss of the volatile electrolyte. Because of the splashing—which is actually intensified due to the gas pumping effect of this electrode orientation—it will be almost impossible to prevent some crust from formings. The crust so formed will then interfere with the anode movement. Furthermore it would be expected that the superstructure construction materials (usually steel) will be subjected to much more severe corrosion conditions due to the open nature of the cell: the bath and its vapour are both extremely corrosive and combined with the hotter ambient temperatures in the absence of a protective crust will exacerbate the situation.

The patent does not take into account that the nearly vertical orientation of the electrodes concentrates all the bubble induced turbulence at the top end of the electrodes, thus producing a highly turbulent regime still within the ACD, which would be conducive to a number of detrimental effects as noted herein in our application. The present invention specifically seeks to reduce these effects.

Both of the last two patents require quite radical departures from and changes to conventional reduction cell superstructures, thus requiring costly rebuilding of cells, adjustments to in-plant routine, and/or alterations to the processing and installation of anodes. The present invention has the advantages of being able to use the existing anode processing stream and only minor changes to the cathode shape which are easily implemented during the normal cathode construction phase.

It is against this background that the present invention has developed.

SUMMARY OF INVENTION AND OBJECTS

It is an object of the present invention to provide an improved aluminium smelting cell having a modified anode and cathode configuration which is adapted to cause a reduction in the deleterious effects of bubble accumulation and turbulent discharge from the anode cathode gap.

The invention provides an aluminium smelting cell comprising a cathode having an active upper surface, a plurality of anodes each having a lower surface spaced from said upper surface of said cathode, at least said lower anode surfaces having at least an outer edge portion thereof sloped in a primary or longitudinal direction of said anode at acute angles falling substantially in the range 1° to 45°, at least said upper surface of said cathode beneath each anode being shaped in a transverse or secondary direction of each anode to cause complementary shaping of said lower anode surfaces is a manner which reduce the migration of bubbles generated between the anode and cathode along said lower anode surfaces in said primary or longitudinal direction to in turn reduce the path length of bubbles generated between said surfaces whereby the turbulence caused by coalesced bubble disengagement from the bath electrolyte is significantly reduced while maintaining adequate bath circulation between said anode and cathode.

By reducing the extent to which the bubbles migrate along the longitudinal surface of said anode, the rate of circulation of the bath up the sloped surface is reduced, while maintaining adequate bath flow to dissolve and supply alumina in the bath, thereby reducing turbulence at the outer edge of the longitudinal surface of said anodes and diminishing the voltage drop caused by excessive bubble accumulation. This in turn increases the current efficiency of the improved aluminium smelting cell having the modified anode and/or cathode configuration in a manner which is adapted to cause a reduction in the deleterious effects of bubble accumulation and turbulent discharge from the anode/cathode gap.

In one form of the invention, at least the upper surface of said cathode beneath each anode is formed with at least one secondary sloping surface extending transversely of said longitudinal surface of each anode. The secondary sloping surface(s) may be at a small acute angle to the horizontal and may be formed with sloping edge portions having a larger angle of inclination. Alternatively, the secondary sloping surface may follow a smoothly curved locus which increases in its angle to the horizontal towards the edges of the anode.

The longitudinal or primary surface of each anode, and the corresponding cathode surface, is preferably sloped at an angle falling substantially in the range 1° to 15°, such as in the manner described in U.S. Pat. No. 4,602,990 Boxall et al, although an inwardly sloping structure may be used.

Alternatively, the primary sloping surface on each anode lower surface may be replaced by an initially flat surface which develops to a smoothly curved bevelled locus at the edge of the anode, having an average angle of slope of about 45°. In this case, the cathode surface may be flat with a suitably shaped and positioned protrusion to form or maintain the shaped anode edge.

In one form of the invention, at least the upper surface of the cathode beneath each anode is divided into at least two portions which extend outwardly from a central lower portion at a small secondary acute angle to the horizontal. Alternatively, the secondary sloping surface may have a central substantially planar portion extending outwardly to each edge in a smoothly curved locus. In these ways, the path length of bubbles generated between said surfaces is reduced and the likelihood of bubbles accumulating into larger bubble groups or larger bubbles is correspondingly reduced.

The upper face of the cathode is preferably formed, at each anode location, with two faces of equal size each of which extends upwardly from a lowermost portion at a small secondary acute angle of the order of 0.5° to 5°. With this arrangement, the bubbles generated in the space between the anode and cathode also flow transversely of each anode following the slope of each face of each anode, rather than following the much longer longitudinal path towards the end of the anode. In this way, the bubbles reach a position at which they are able to vent from the cell before they have an opportunity to accumulate into significantly larger bubble groups or bubbles.

Where consumable anodes are used, the lower surface of each anode will in use burn to a shape similar to the shape of the corresponding part of the cathode surface. Of course, the lower surface of each anode may be preformed with a profile corresponding to the cathode profile but such preforming may be unnecessary. However, where non-consumable or inert anodes are used, the lower surface of each anode will be suitably shaped in a manner similar to the corresponding part of the cathode before installation in the cell.

Additional benefits, including improved bubble removal and bath flow characteristics, may be obtained by adopting cathode surface shapes and angles other than those described above.

The small acute secondary angles described above are, in principle, sufficient to provide the necessary enhanced bubble release characteristics. However, it has been determined that such configurations are most appropriate for shorter term plant trials (<4-8 weeks) or if non-consumable (i.e. inert) anodes should be employed. However, in longer term plant practice, or when consumable anodes are employed, a number of cell operational influences tend to work against the maintenance of such small high-tolerance angles. Thus the heaving, distortion and structural errors of the cathode surface, caused by such occurrences as sodium intercalation and swelling, differential thermal expansions during heat up and/or construction limitations, may tend to nullify the small acute angles impressed onto the cathode surface and may lead to gross intolerances.

In such cases another preferred form of the invention involves the use of transverse secondary angles of magnitude greater than about 2°-5°. The use of transverse angles with greater magnitude serves to diminish the effect of construction intolerances, thus making pot construction less time consuming and the design tolerances less critical. The impact of any cathode heaving is also made less problematic when employing angles of larger magnitude since an appropriate amount of cathode transverse slope will always remain on the cathode surface even after heaving. Thus the anode lower surface will continue to burn to a profile that allows enhanced release of gas bubbles.

However, the use of transverse angles of magnitude significantly greater than about 2° may in turn impose unwanted operational difficulties (e.g. anode setting) due to the resulting corrugated nature of the cathode surface and the height of the resulting corrugations. For example, with a transverse angle of 10° and a cathode block half-width of 222 mm, the height of the corrugation peak amounts to about 40 mm. This may cause, in some cases, difficulties with the location of new anodes during anode setting and their proximity to the hard cathode surface.

Thus, in a preferred form of the invention, it is beneficial for practical cell operation to employ a design that achieves the combined degree of enhanced bubble release, controlled turbulence level and induced bath flow, but is also less susceptible to the pot installation and operational difficulties described above.

In the course of utilizing the embodiment of the invention described above, it was discovered that under certain circumstances surprisingly good operational results were obtained, equal to or exceeding the results typically obtained with cells according to the above embodiment, but without requiring the exacting construction tolerances implied by angles as small as 0.5° to 5°. Thus, in the above embodiment, cells were constructed to incorporate both 4° primary (longitudinal) and 2° secondary (transverse) slopes on the cathode surface. Care and effort is needed to ensure that the correct transverse angles are applied and maintained during the pot construction phase. The process involves detailed measurements with cross-checking and. whilst effective, is consequently both a demanding and time consuming activity.

Pots constructed according to the 4°/2° V-shaped design produced operational results that were consistent with each other and provided an improved performance over that obtained with pots which possessed only a single longitudinal slope. Table 1 compares the performance of several pots possessing the V-shaped design with those possessing the single-sloped design. The data was accrued from actual plant trials in 88-116 kA cells, but the results have been normalized to constant bath chemistry, constant AGD and constant current density to allow a true comparison. It will be seen that the cells employing the 4°/2° V-shaped electrodes (anode design 2) provided a voltage benefit over those cells which employed only the single sloped electrodes (anode design 1) as expected.

TABLE 1

A comparison of the normalized voltage benefits for different anode designs.

| | ANODE DESIGN | | |
|---|---|---|---|
| | 1 | 2 | 3 |
| Cell Volgage* (volts) | 4.25-4.6 | 3.95-4.1 | 3.55-3.95 |

*Normalized to 1A/cm², 2.5 cm ACD.
Design 1: Single longitudinal slope (8°)
Design 2: V-shaped double slope (4° longitudinal/2° transverse)
Design 3: Improved design (4° longitudinal bevel sided).

However, in other cells which we have operated, inadvertent variations to the usual construction process, which required less attention to detail, produced modifications to the 4°/2° V-shaped cathode design such that a significantly different cathode profile was achieved. When cells according to these construction modifications were operated, an improved voltage benefit, superior to that achieved by the V-shaped design, was obtained over those cells possessing just the single sloped design.

In view of these cell performance benefits, and lower demands during construction, the characteristics and advantages of the design were further determined by us using detailed hydrodynamic flow modelling experiments and computer simulations.

In hydrodynamic flow modelling it has long been known that water at room temperature can be used as a model for the study of the flow patterns occurring in aluminium reduction cells operating with cryolitic baths at around 1000° C. For example, E. DERNEDDE et al (*LIGHT METALS*, P. 111, 1975) describe the use of a water analogue model for determining the gas induced circulation in an aluminium reduction cell. Similarly, U.S. Pat. No. 4,602,990 Boxall et al) shows that a 1:1 scale water analogue model of an aluminium reduction cell with a sloping cathode surface can be used successfully to visualize and predict the induced bath flows and bubble release behaviour resulting when different cell conditions were employed. Thus the effect of varying the anode-cathode distance, the return channel spacing, the anode and/or cathode shapes, and the like, on the expected bath flow patterns, the efficiency of alumina dispersion, the bubble venting characteristics and the degree of turbulence at different locations in an operating cell have been readily determined in room temperature models. The results of these studies have in the past been used successfully for the design of cells possessing sloping cathodes, as exemplified by the operating results obtained from the pilot scale cell described in U.S. Pat. No. 4,602,990 and from the plant cells described in greater detail below.

Experimental work conducted in a water analogue model showed that an improved anode and/or cathode design which provides the above-mentioned combined hydrodynamic and construction advantages includes bevelled edges having a secondary angle of about 1° to 45°, preferably 2° to 20°, and most preferably around 15°.

In one particular embodiment, the profile of the cathode below each anode includes a central planar region and bevelled edges having an angle of about 15° to the horizontal.

The invention defined above is particularly applicable to cells of the type described more fully in U.S. Pat. No. 4,602,990, the contents of which are incorporated herein by cross reference.

BRIEF DESCRIPTION OF THE DRAWINGS

Two presently preferred embodiments of the invention will now be determined with reference to the accompanying drawings in which.

DESCRIPTION OF PREFERRED EMBODIMENTS

Figure 1:
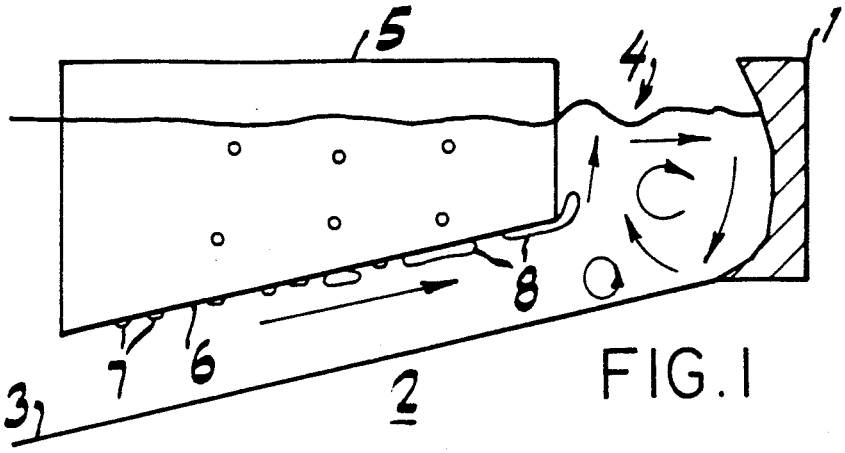
FIG. 1 is a schematic sectional elevation of an anode/cathode arrangement of the general type described in U.S. Pat. No. 4,602,990.

Referring firstly to FIG. 1 of the drawings, part of a cell according to U.S. Pat. No. 4,602,990 is shown in which the cell 1 includes a cathode 2 having an upper surface 3 formed from an aluminium wettable refractory hard material, said upper surface 3 being upwardly inclined to encourage the bubble induced flow of the electrolyte material towards a side reservoir 4. An anode 5 has a similarly upwardly shaped lower surface 6 whereby a uniform anode-to-cathode distance ACD is created. As shown in FIG. 1, the bubbles 7 which are generated in the space between the surfaces 3 and 6 move along the lower surface 6 towards the side reservoir 4 where they are vented to the atmosphere. The bubbles 7 tend to accumulate into larger bubbles 8 which cause an increase in directional turbulence in the electrolyte in the side reservoir 4, which in turn leads to bubble streams which impinge on the cathode surface at the upper end of the cathode slope and induce cathode crosion or wear at these portions. This in turn results in a shortening of the effective life of the cell 1. In addition, as mentioned above, the accumulation of bubbles usually results in reduced current efficiences in the cell.

Figure 2:
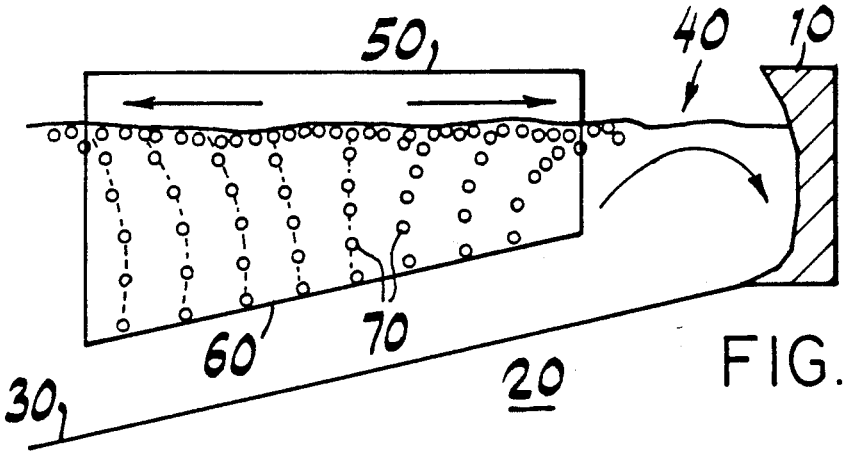
FIG. 2 is a similar schematic sectional elevation of an anode/cathode arrangement embodying the present invention.
Figure 3:
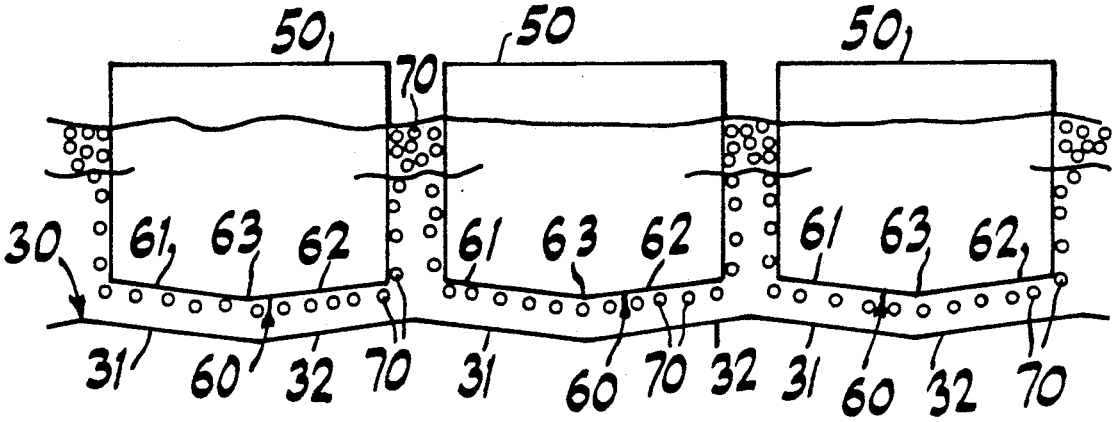
FIG. 3 is a schematic end elevation through a drained cathode cell of the type described in U.S. Pat. No. 4,602,990, in which the anode/cathode arrangement embodies the present invention.
Figure 4:
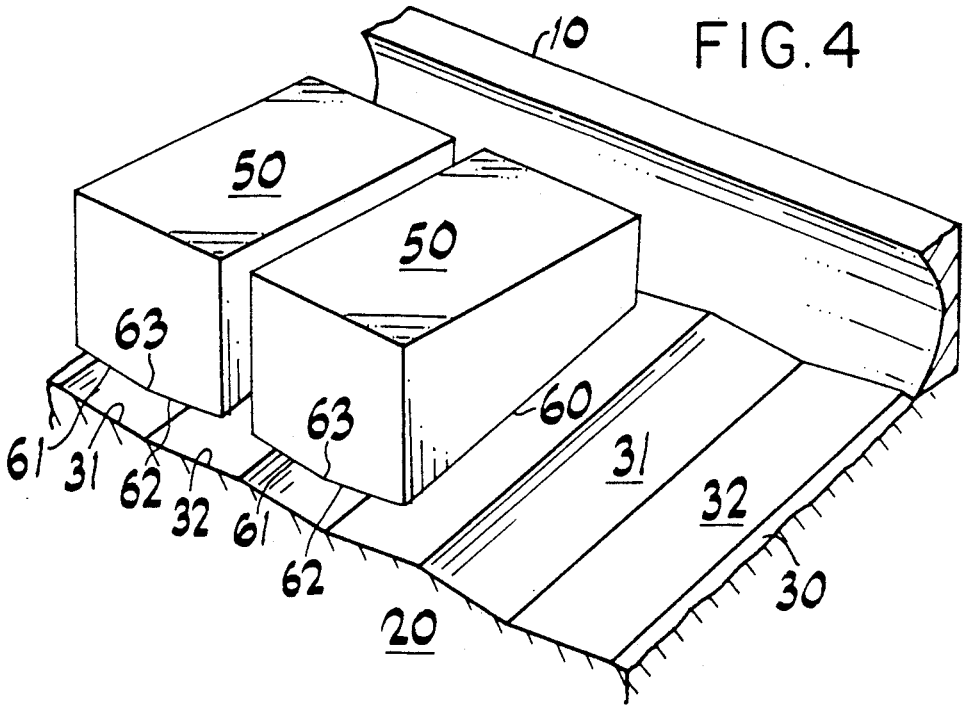
FIG. 4 is a fragmentary sectional perspective view of the cathode/anode arrangement of FIGS. 2 and 3.

Referring now to FIGS. 2, 3 and 4 of the drawings, the cell 10 is of essentially the same construction as the cell shown in FIG. 1, having a cathode 20 having an upper surface 30, a side reservoir 40, and an anode 50 having a lower surface 60. The difference embodying the present invention is that the upper surface 30 of the cathode 20 is formed with pairs of secondary inclined surfaces 31, 32 extending transversely of and immediately below each anode 50, the lower surface 60 of which has correspondingly inclined secondary surfaces 61 and 62 meeting at a region or line 63. In experiments thus far conducted, the surfaces 31, 32 and 61, 62 are inclined at a small secondary acute angle of the order of about 2°. With such inclined surfaces, it is found that the bubbles 70 which form in the space between the anode 50 and the cathode 20 also flow towards the sides of the anode 50 in the manner shown schematically in FIGS. 2 and 3 of the drawings. Thus, the formation of secondary inclined surfaces on the corresponding portions of the cathode and anode significantly reduce the bubble path lengths of the arrangement shown in FIG. 1 of the drawings and reduce the likelihood of accumulation of the bubbles 70 into larger bubbles or bubble groups. This in turn substantially reduces the amount of turbulence being concentrated in the side channel 40 and is likely to significantly reduce the amount of wear to the cathode and anode surfaces, thereby increasing the effective life of the cell 10. Furthermore, the reduction in bubble accumulation is likely to increase the current efficiency of the cell.

While the above embodiment includes cathode surfaces 31 and 32 having pairs of inclined surfaces and corresponding anode surfaces 61 and 62 extending upwardly from a lower region or line 63, it should be appreciated that improved results may be obtained by the formation of a series of single inclined surfaces in the cathode 20 and on the lower surface 60 of the anode. If such a single surface is adopted, it is preferred that the direction of inclination of each such surface on the cathode and on the lower faces 60 of adjacent anodes should be in opposite directions. Similarly, the lower surface of each anode, and the corresponding parts of the cathode, may be formed with more than two secondary inclined surfaces, such will be described further in relation to FIG. 10 of the drawings.

While the tests which have been currently conducted indicate that adequate bubble movement towards the sides of the anode may be achieved with a secondary surface angle of about 2° bubble movement may be achieved with angles as small as about 0.5°, and while the main angle of inclination of the cathode may be as high as 15°, a maximum angle of inclination of the order of 4° to 10° should be sufficient. Clearly, if adequate transverse bubble movement is able to be achieved with an angle of inclination of the order of 2°, then the adoption of a larger angle would appear to be somewhat wasteful. However, there may be other reasons for adopting larger angles.

Figure 5:
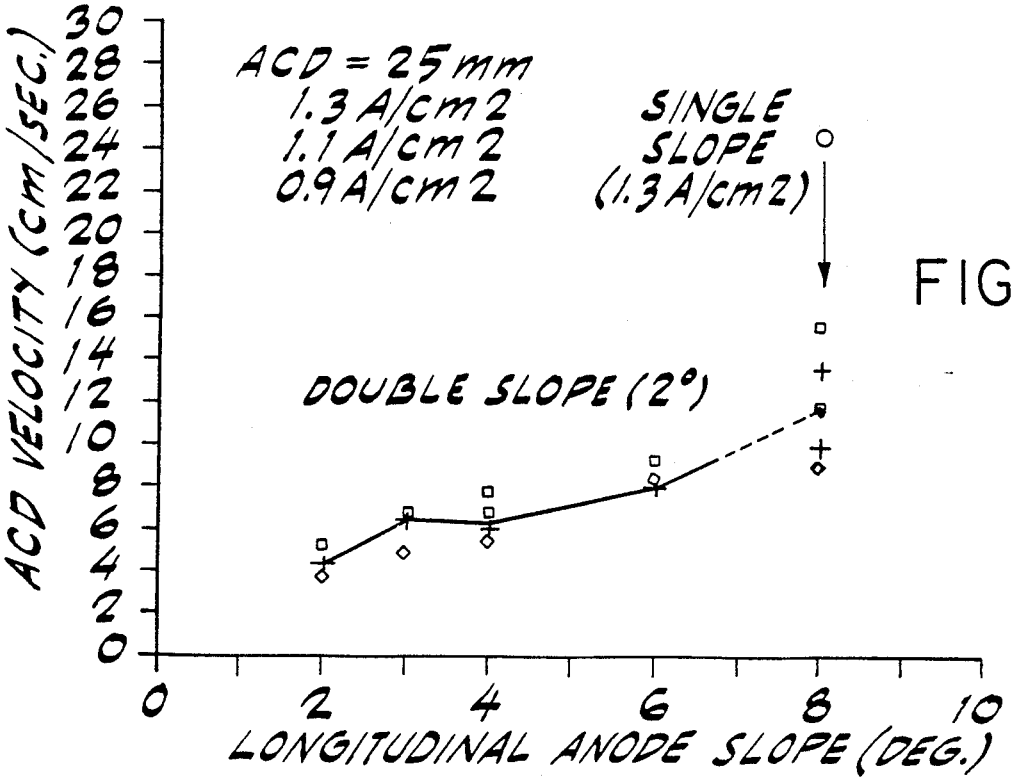
FIG. 5 is a graph showing the average ACD velocity with respect to the longitudinal slope angle of the anode as determined from water modelling.
Figure 6:
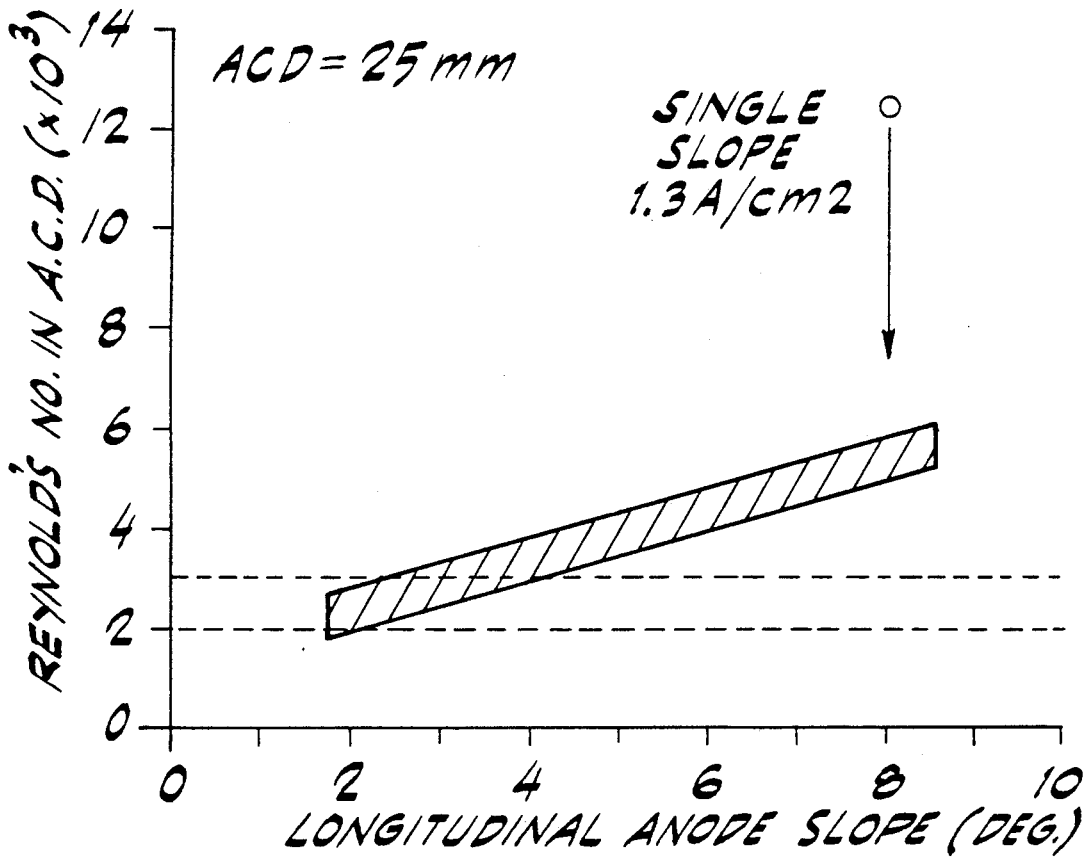
FIG. 6 is a graph showing the change in Reynolds No. with respect to changes in longitudinal anodes slope as determined from water modelling.

FIG. 5 shows the average velocity of liquid in the ACD with respect to the angle of the longitudinal cathode slope, as determined from water modelling at different simulated anodic current densitites. The graph illustrates that the bubble induced liquid flow velocity is markedly reduced when an electrode design according to FIGS. 2 to 4 is substituted for the single sloped design of FIG. 1. Further reductions in average velocity are obtained by decreasing the angle of the longitudinal slope. FIG. 6 shows that the bubble induced turbulence in the ACD, defined here using the average Reynolds' number, is also decreased in the same circumstances. The likelihood for back reaction between the anode and cathode products is therefore reduced.

Figure 7:
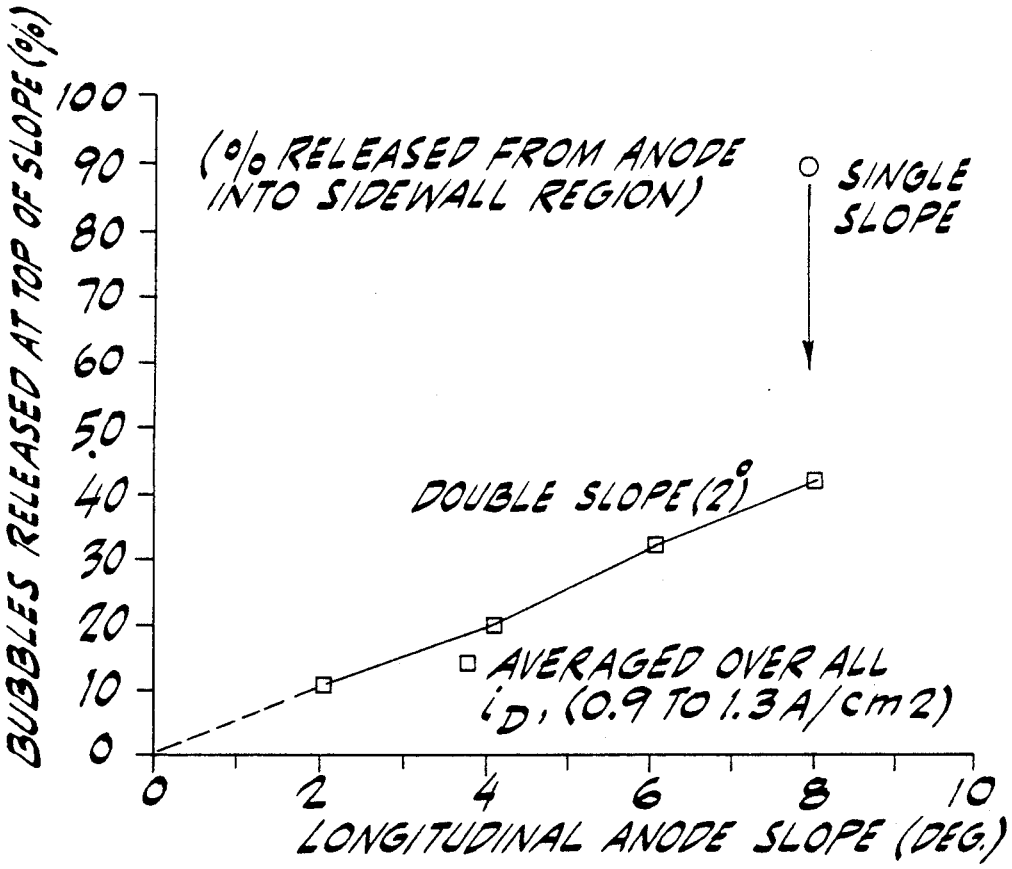
FIG. 7 is a graph showing the percentage of bubbles released at the top of the slope with respect to changes in the longitudinal anode slope as desired from water modelling.
Figure 8:
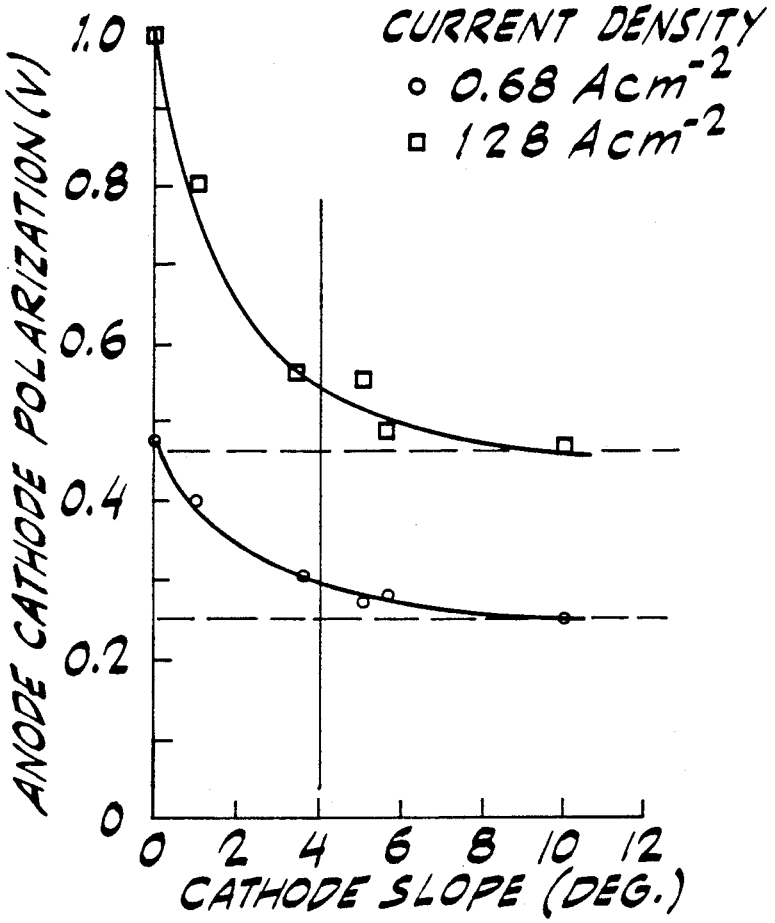
FIG. 8 is a graph showing anode-cathode polarization with changes in the longitudinal anode slope.

FIG. 7 provides estimates, obtained from water modelling, of the percentage of bubbles which travel along the entire length of the anode and are released at the top of the longitudinal slope. For a single sloped anode nearly all of the bubbles (>90%) travel the length of the anode, whilst the design embodying the invention reduces this percentage by about half. Further decreases are obtained by decreasing the angle of the longitudinal slope. This data illustrates that the release of bubbles becomes more evenly spread around the periphery of the anode and that the bubble release path is correspondingly decreased. The likelihood for bubble coalsescence and accumulation along the length of the anode is thereby diminished. FIG. 8 shows data previously obtained from a pilot scale aluminium reduction cell containing a drained wetted cathode design and demonstrates that, although the anode-cathode voltage savings reaches a maximum value at a longitudinal slope of about 8° the cathode slope may be reduced to 4° yet still maintain approximately 80–90% of the maximum voltage benefit.

The graphs of FIGS. 5 to 8 therefore indicate that the longitudinal slope of the corresponding surfaces 30 and 60 of the cathode and anode should preferably be less than about 8°, contrary to the indication of preferred cathode slope contained in U.S. Pat. No. 4,602,990, although an 8° slope is still very effective. It is clear from the graphs that the ACD velocity decreases with slope angle, that bath resistivity and turbulence in the ACD decreases with angle, that the 2° transverse slope is effective for removing bubbles with consequential reduction in bubble coalescence and the transfer of potentially harmful "bubble energy" or turbulence from the side wall channel or top end of the anode to the sides of the anodes. As the longitudinal anode slope reduces, bubble entrapment at the top end of the anode is further reduced and the flow of electrolyte in the ACD approaches desirable laminar conditions. It follows from the above observations that there are no apparent detrimental influences from reducing the longitudinal slope of the cathode and anode surfaces, that reduction of the longitudinal cathode slope to less than 8° produces beneficial effects, and the currently preferred slopes are 4° longitudinal and 2° transverse.

While the preferred embodiment described above shows the lower surface of the anode as having an inclined surface corresponding to the upper surface of the cathode, it will be appreciated that the anode need not necessarily be preformed with a sloping lower surface, although this may be preferred for optimum operational conditions. The lower surface of the anode may be initially perpendicular, the required slope being effectively "burnt" into the lower face of the anode during operation of the cell.

Figure 9:
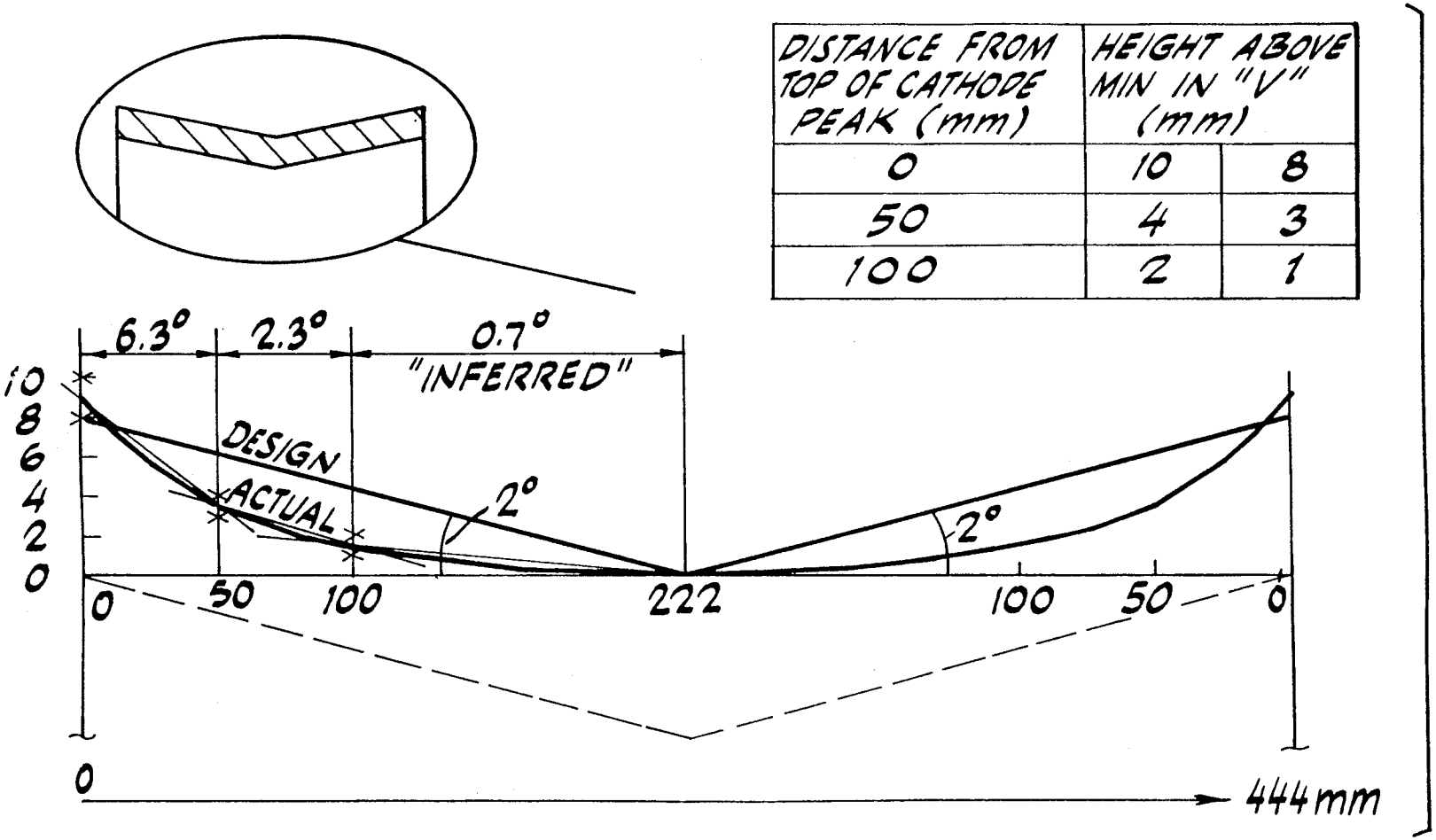
FIG. 9 is a comparison of the designed cathode profile and the estimated actual cathode and anode profiles in practice.

FIG. 9 compares the format of the as-designed V-shape profile with an estimation of the profile actually installed as determined from in situ measurements obtained after construction. When cells according to these construction modifications were operated, the results given in Table 1 (anode design 3) were acquired). An improved voltage benefit superior to that achieved by the V-shaped design, was obtained over those cells possessing just the single sloped design.

Referring now to FIGS. 10 to 16, the "bevelled" design in principle consists of a generally planar narrow liquid flow region 11 and more steeply bevelled edges 12 and 13 of about 15° which provide for a more rapid sideways bubble removal than exhibited by the transverse slopes of 2° shown in FIGS. 2 and 3, and define liquid flow region 11, wherein slower sideways bubble release occurs and the bath electrolyte is induced to flow along the ACD thereby providing for good transport of alumina between the electrodes.

Figure 10:
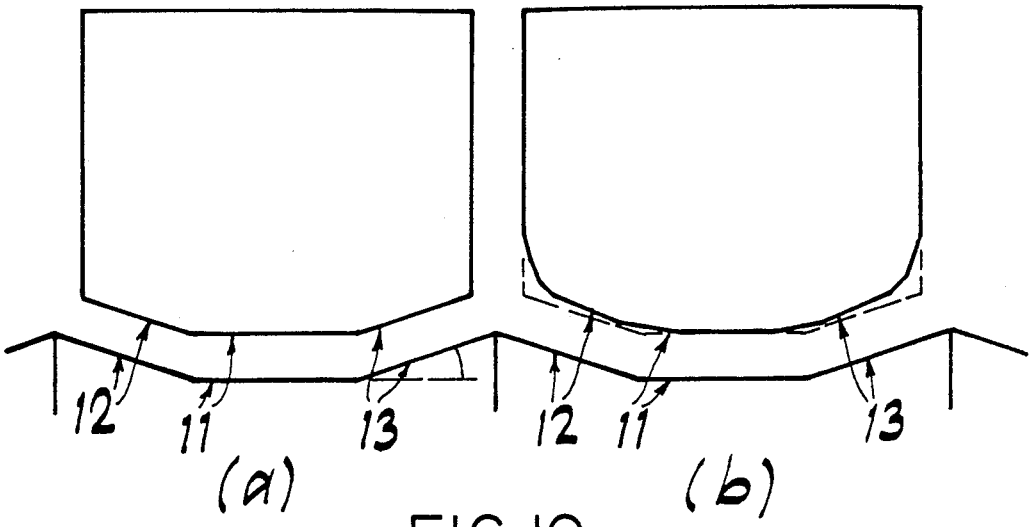
FIG. 10 is a schematic end elevation similar to FIG. 3 showing another cathode/anode configuration embodying the invention, (a) in idealised form and (b) in a more practical form with the two regions on the anode merged.

Perspex anodes of the bevel design shown in FIG. 10(*a*) were constructed for use in a water model. The combined width of the bevelled area was designed to allow at least 50% of the generated bubbles to exit rapidly via the sides of the anodes. In order to become independent of installation and operational intolerances, bevel angles of about 15° were selected.

Tests in the water model, employing the 'bevel' anodes described above, have demonstrated that the bevel geometry achieved similar reductions in both the average velocity and the average Reynolds number turbulence in the ACD, when compared with the behaviour of anode geometries employing a 2° transverse slope. The comparative performance of the two anode designs are shown in FIGS. 11 and 12 respectively.

Figure 11:
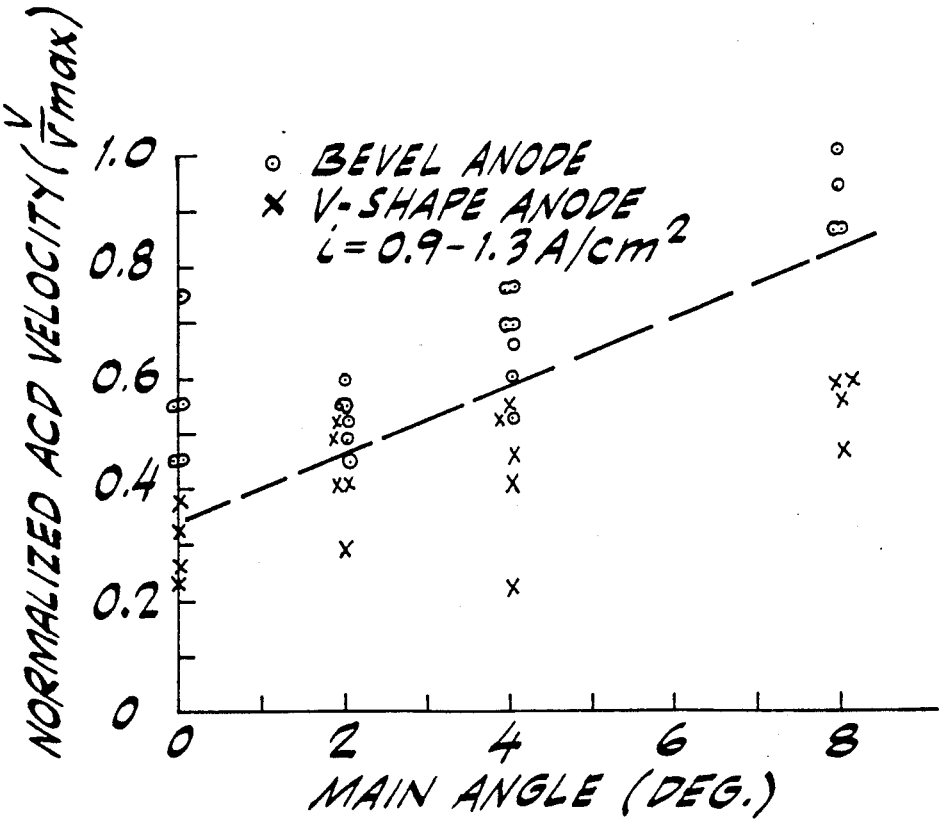
FIG. 11 is a comparison of the normalised electrode gap velocity graph for various primary angles of the cathode when the V-shape (FIGS. 2 and 3) and the bevel shape (FIG. 10) anodes are used.
Figure 12:
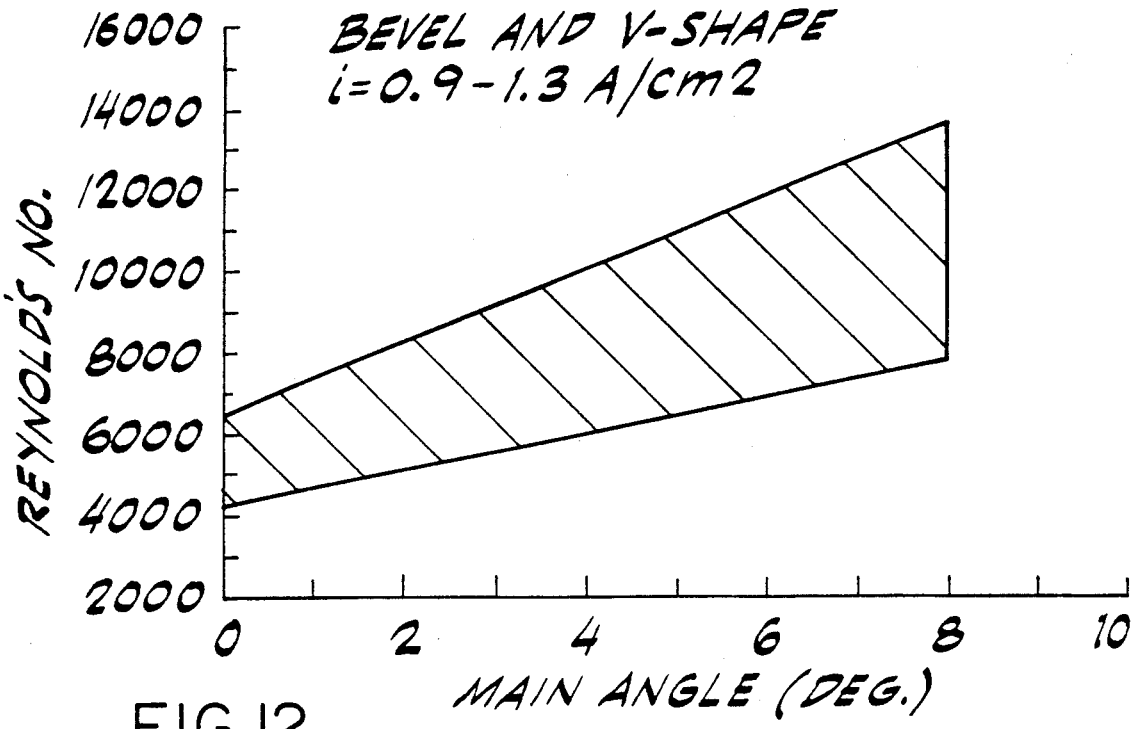
FIG. 12 is a Reynolds No. Graph comprising the two shapes embodying the invention.

FIG. 11 shows that the electrolyte velocity in the ACD is reduced to corresponding levels by both the bevel and the V-shaped designs following decreases in the angle of the main (longitudinal) cathode slope. This reduction in velocity to lower levels has benefits for reducing the degree of ACD turbulence, as shown correspondingly in FIG. 12, which is important for minimizing the likelihood of back reaction by the deposited metal and a lowering of current efficiency. Furthermore, the supply of alumina to the ACD and throughout the cell via the main flow patterns was also simulated in the water model by tracer dye additions. Overall, the bevel anode geometry produced a bath flow pattern and alumina dispersion characteristics very similar to those generated by the 2° transverse slope design. The 2° transverse slope anodes have, in turn, been found to produce entirely satisfactory planet performance during the period when they are able to maintain stability of their design.

These results illustrate that, despite the differences in installed geometry, the bevel design will achieve benefits at least as good as the 2° transverse geometry. Additionally, however, the bubble release path length for bubbles forming on the anode surface and within the bevelled regions 12 and 13 was observed to be considerably shorter than the bubble path length observed with the 2° transverse slope anodes. This comparison of observed bubble release behaviour is shown most clearly in FIG. 13. The enhanced bubble release mechanism produces less residual gas volume remaining in the ACD and therefore reduces the risk of current inefficiencies by back reaction between the products of electrolysis. It also promotes a reduction in the resistive influence of the bubble layer, thereby leading to voltage benefits as shown in Table 1 and more fully in the following description relating to FIG. 15.

Whilst the above description of the embodiment describes the theoretical basis for the design, in practice the two regions 11 and 12,13 on the underside of a consumable anode will lend to merge into a single continuous surface, as shown schematically in FIG. 10(*b*). The features of the bevelled design may then be more partically implemented by employing relatively steep-sided yet low protrusions that have been formed onto the upper surface of the cathode blocks during construction of the cell. One example is to form protrusions along the longitudinal edges of the cathode blocks. These steep-sided bevels are able to induce, by judicious selection of their dimensions, the appropriate amount of anode burning on the lower surface of the consumable anodes during cell operation, thus producing a desirable degree of anode rounding favourable for controlled bubble release and induced bath flow.

Figure 14:
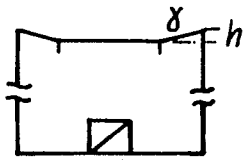
FIG. 14 is a comparative table showing electric burn modelling results.
Figure 14:
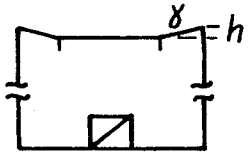
Figure 14:
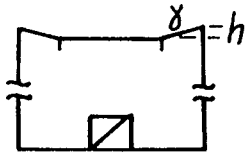
Figure 14:
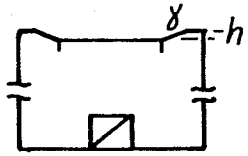

In this case, the degree of anode burning to be induced by the different cathode lopographics was predicted from detailed computer calculations using a proven electrical model based on computing the isopotential contours developed at the anode surface. FIG. 14 summarizes some representative results obtained from this modelling work. The results confirm that appropriate burned-in anode lower surface shapes will be readily achieved by modification of the cathode upper surface topography in the manner shown in FIG. 15.

Figure 15:
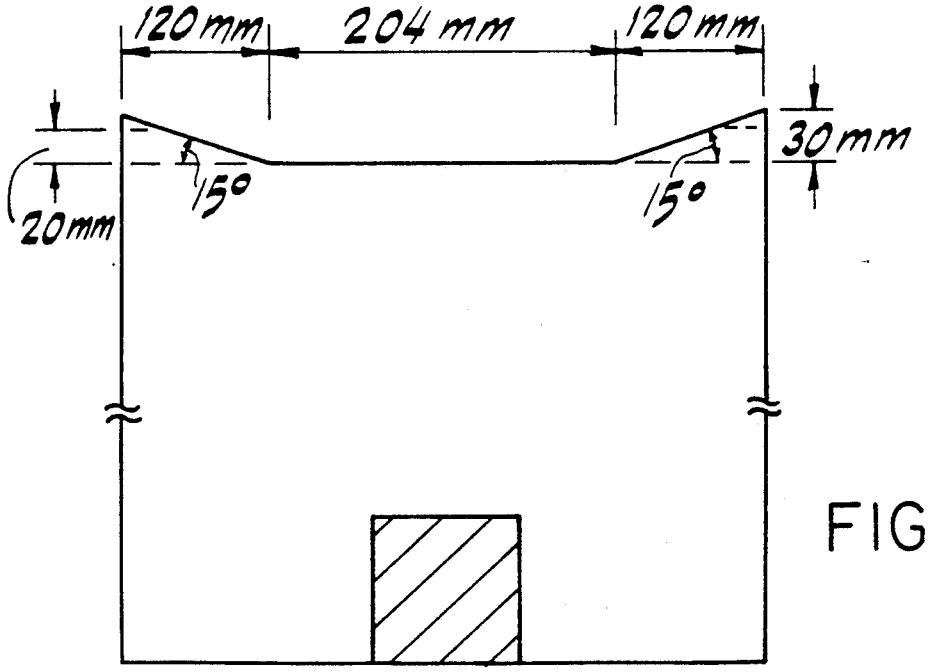
FIG. 15 shows the cathode contour required for a bevel profile of FIG. 10(*b*)
Figure 13A:
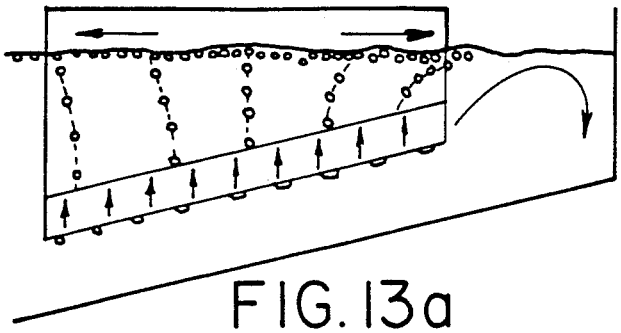
FIG. 13 are schematic representations of the two cathode/anode profiles showing the bubble release pattern in each case, (a) and (b) bevel anode, (c) and (d) V-shaped anode and (e) and elevation of both types.
Figure 13B:
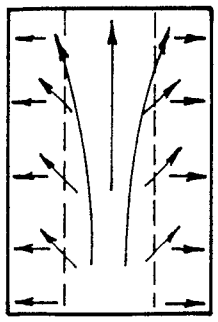
Figure 13C:
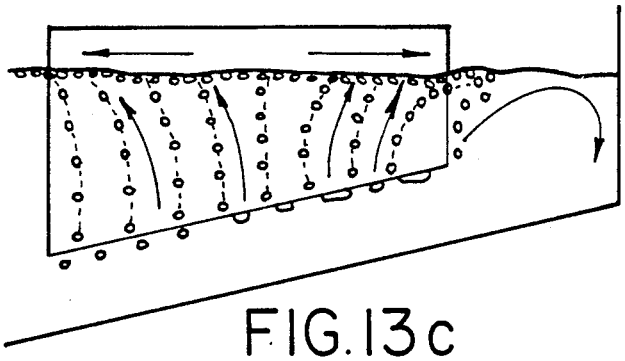
Figure 13D:
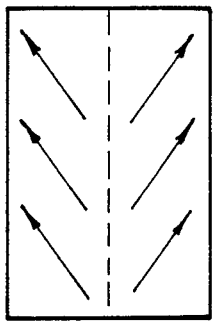
Figure 13E:
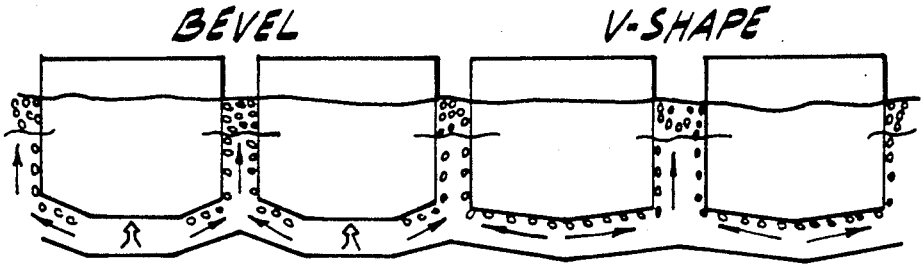

In the computer simulation, it was also determined that the height of the cathode protrusions could be minimized somewhat to restrict the cathode corrugations to a more compact level, yet still achieve the desired mode profile. FIG. 15, for example, shows in detail the case 4 example from FIG. 14, which demonstrates that in this case the height of the cathode protrusion can be kept to about 20mm for a 444mm while cathode block and a transverse angle as large as 15°.

Figure 16:
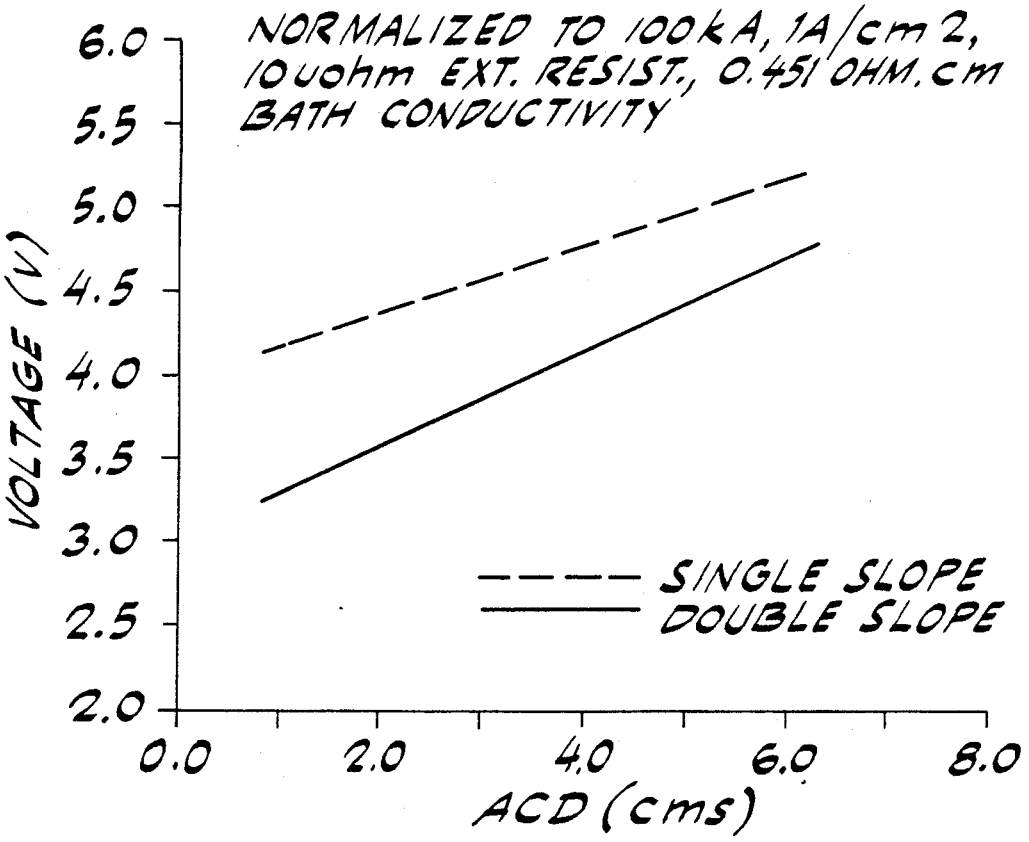
FIG. 16 is a comparative graph showing the relationship between cell voltage and ACD for a drained cathode cell modified according to the invention (bevel slope anode) and for a non-modified drained cathode cell (single slope)

Referring now to FIG. 16, the relationship between the cell voltage and the cell anode-cathode distance (ACD) is shown for drained cathode cells of the type described above and for drained cathode cells which have been modified according to the invention.

FIG. 16 represents smoothed data of cell voltage versus ACD obtained from plant scale cells operating with drained wetted cathodes. These cells employed cathodes with either the single longitudinal slope design or the special double sloped design described herein. The data from the double sloped design lie below the data for the single sloped design and demonstrate that a clear voltage benefit is achieved when the double sloped cathode design is employed.

This benefit is believed to be due to the improved way in which the bubbles are released from under the anode; viz, by a shorter bubble escape path, thereby giving less accumulated bubble volume, and in a controlled manner along the edges, thereby keeping turbulence to a low level by minimizing the sudden venting of large gas volumes.

Although specific examples of this embodiment have been provided in the above description, it will be apparent from the description of the invention that persons skilled in the art can propose variations in the design and magnitude of the transverse angle and type of protrusion which will also provide acceptable enhanced bubble release, induced bath flow and alumina dispersion, whilst also providing the requisite ease of construction as well as a tolerance to construction and operational variations. Thus, the onset of the transverse (secondary) angle may start at any location across the width of the upper surface of the cathode block, beginning from the centreline and ranging to locations beyond the edge of the anode shadow. Alternatively, the transverse profile shown in FIG. 3 may be modified by the provision of bevelled edges as described above. Further, smoothed concave depressions or convex elevations on the cathode surface, each depression or elevation consisting essentially of a single continuous surface rather than the multi-facelled surfaces described above, can be used. A discrete transverse slope or slopes would not in this case be appropriate. Rather the transverse slope would change with distance across the cathode block width.

It should further be noted that the forming of the required anode shape in situ, by the equipotential burning induced via the cathode topography, is controlled by the distribution of the various resistive pathways which the passage of the electrolysis currents follow between the anode and the cathode. Thus, the present invention also includes such cathode designs that cause the desired amount of anode shaping to occur through in situ burning by the deployment or manipulation of resistive elements. In this way, the resulting burned-in transverse anode slope(s) will be controlled and define by the utilization and strategic placement of specific resistive mechanisms that will promote and/or limited the naturally occurring current pathways. Such resistive mechanisms include, but are not limited by, the following: the placement of the cathode current collection bars; the alternative placement of high resistance cathode blocks between low resistance cathode blocks and the like.

It will be clear from the above description that the above embodiments are most applicable to aluminium reduction cells employing consumable anodes. In the case where the installation of an inert (non-sonsumable) anode becomes available to the industry, it will be necessary to preform the transverse slopes onto the lower surfaces of the anodes prior to placement in the cell. It will in this case not be necessary to also form transverse sloping surfaces on the cathode blocks in order for the functions of the design to succeed. However, there may be other reasons why it would be necessary to maintain an essentially parallel contour on the cathode surface. For example, to provide a close fit at extremely low ACD's.

Although the above description and specific examples of preferred embodiments of the present invention relates to wetted cathode cells in which the primary wetted surface and the base of the cell cavity are essentially the same and in which metal run off and collection occurs usually in a remote sump, the invention is not limited to such cells. Other types of cells in which the RHM cathode surface is realised as separate cathode elements that protrude out of the molten aluminium pool may also be used in the realisation of the invention. The cathode elements may take different forms (e.g. cylinders, squares, rods, tubes, "mushrooms", pedestals) as described more fully in K. Billehaug and H.A. Ø ye "Inert cathodes for aluminium electolysis in Hall-Heroult cells". *ALUMINIUM* vol. 56, Nos. 10 [pp. 642–648] and 11 [pp. 713–718] 1980, but the anode still "sees" a hard surface that acts as the active cathode. In such cells metal forms on these elevated active surfaces and runs off or falls into the metal reservoir residing below them. Shaping of these cathode elements, or groups of elements, or the strategic placement of these elements or groups of elements, to achieve the desired degree of anode shaping is within the scope of the present invention.

Figure 17:
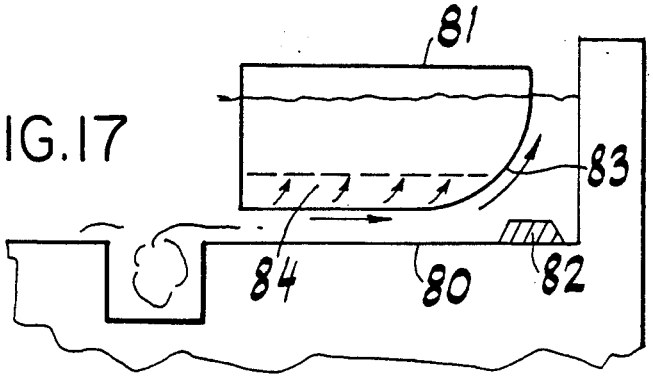
FIG. 17 is a fragmentary sectional end elevation of a drained cell according to another embodiment of the invention.

Referring now to FIG. 17 of the drawings, the above described embodiments have referred to an aluminium reduction cell of the general type described in U.S. Pat. No. 4,602,990, in which the cathode possesses a primary longitudinal slope of between 2 to 15°. This primary sloping surface induces the flow of electrolyte along the interelectrode gap. In another embodiment of the invention, shown schematically in FIG. 17, the flow of electrolyte along the interelectrode gap is induced to occur in a horizontal wetted cathode cell, that is, a cell with a primary cathode slope of 0°, by the judicious placement of cathode protrusions 82. In one such case, appropriate large protrusions 82 incorporated onto the cathode surface and positioned beneath that end of the anode 81 towards which the flow of electrolyte is required, will induce the burning of a steep smoothly curved bevelled surface 82 on the lower anode surface. Each anode 81, and the corresponding upper surface of the cathode 80 have transverse sloped or smoothly curved transverse surfaces 84 of any one of the types described above. The bubble pumping action caused by the surface 83 and by the transverse anode surfaces 84 along the length of the anode 81, together with the continuity requirement for mass flow, will produce a nett movement of liquid bath into the interelectrode or ACD region and along the anode. Thus the induced bath flow and controlled bubble release requirements outlined above can be simultaneously achieved by the strategic placement of cathode protrusions, which in turn produce the appropriate burning and shaping of the anode profile according to the desired design.

The abutment 82 shown schematically in FIG. 17 may take any suitable form, including studs, tubular elements, plates or grates of the type shown in FIGS. 14 to 16 of Billehaug and Ø ye referred to above.

We claim:

1. An aluminum smelting cell comprising a cathode having an active upper surface, at least one anode having a lower surface spaced from said upper surface of said cathode, said cathode upper surface being sloped in a primary direction at an acute angle to the horizontal falling substantially in the range of 1° to 45°, said cathode upper surface being further sloped in a transverse direction at an acute angle to the horizontal falling substantially in the range of 0.5° to 20°, in a manner which reduces the migration of bubbles generated between the anode and cathode along said lower anode surface in a primary direction, reduces the path length of bubbles generated between said upper and lower surfaces and reduces any turbulence which would be caused by coalesced bubble disengagement in a bath electrolyte while maintaining adequate bath circulation between said anode and cathode.

2. The cell of claim 1, wherein said at least one secondary sloping surface further comprises two secondary sloping surfaces each extending outwardly transversely from a central position at an acute angle falling substantially in the range of 0.5° to the horizontal.

3. The cell of claim 2, wherein said secondary sloping edge region extends transversely at an acute angle falling substantially in the range of 2° to 20° relative to the horizontal.

4. The cell of claim 3, wherein said secondary sloping edge region extends transversely at an acute angle falling substantially in the range of 2° to 20°.

5. The cell of claim 1, wherein said anode lower surface is shaped with a smoothly curving transverse surface having an acute angle which increases relative to the horizontal to ware the edge region.

6. The cell of claim 1, wherein said lower surface of the anode and the corresponding upper surface of said cathode is outwardly and upwardly sloped in the primary direction of an acute angle falling substantially in the range of 1° to 15° to the horizontal.

7. The cell of anyone of claims 1, 2 or 4, wherein said lower surface of the anode has its outer edge region bevelled or smoothly curved in the primary direction.

8. The cell of claim 6, further comprising means positioned and configured to initially form and maintain the bevelled shape of said outer edge.

9. The cell of claim 7 wherein said means comprises an abutment formed o a generally horizontal cathode surface.

10. The cell of claim 6, wherein said bevelled outer edge is in the form of a smoothly curved surface having an acute angle which increases relative to the horizontal towards the edge of the anode.

11. The aluminum smelting cell of claim 1, wherein the cathode upper surface causes complementary shaping of the anode lower surface during use.

12. The aluminum smelting cell of claim 1, wherein the cathode upper surface is divided into at least two portions which extend outwardly from a central lower portion.

13. The aluminum smelting cell of claim 1, wherein the anode is shaped during use.

14. The aluminum smelting cell of claim 1, wherein the anode lower surface is shaped is shaped prior to use.

15. The aluminum smelting cell of claim 14, wherein the anode lower surface is shaped by means of an abritment.

16. An aluminum smelting cell comprised of an anode having an active lower surface sloped in a primary direction at an angle ranging from about 1° to 45° relative to horizontal and in a transverse direction at an angle substantially in the range of 0.5° to 20° relative to horizontal, and a cathode having an active upper surface separated from the active lower surface of the anode, shaped in a primary direction at an angle ranging from about 1° to 45° relative to horizontal and in a transverse direction at an angle substantially in the range of 0.5° to 20° relative to horizontal.

17. The aluminum smelting cell of claim 16 wherein the angle in the transverse direction reduces the migration of bubbles in the primary direction during use.

18. The aluminum smelting cell described in claim 16 wherein the active lower surface is comprised of an outer edge portion sloped in the primary direction and a central planar region.

19. The aluminum smelting cell described in claim 17 wherein the outer edge portion contains a secondary sloping edge region extending transversely at an angle falling substantially in the range of 2° to 20° relative to the horizontal.

20. The aluminum smelting cell described in claim 16 containing a plurality of anodes.

21. The aluminum smelting cell described in claim 18 wherein the active lower surface is further comprised of a secondary sloping surface extending transversely from the central planar region to the outer edge portion at an angle falling substantially within the range of 0.5° to 5° relative to the horizontal.

22. The cell of claim 8 wherein said bevelled edge is a curved surface having an acute angle which increases relative to the horizontal towards the edge of the anode.

23. An aluminum smelting cell cathode having an active upper surface with at least an outer edge portion sloped in a primary direction at an angle relative to horizontal falling substantially in the range 1° to 45°, said active upper surface further being sloped in a transverse direction relative to the horizontal which is effective for reducing the migration of bubbles in the primary direction generated between the cathode and an anode during use.

24. The cathode of claim 23 wherein said active upper surface is further comprised of at least one secondary sloping surface extending transversely at an acute angle falling substantially in the range 0.5° to 20° relative to horizontal.

25. The cathode of claim 23 wherein said active upper surface is further comprised of two secondary sloping surfaces each extending outward transversely from a central position at an acute angle falling substantially in the range 0.50 to 5° relative to horizontal.

26. The cathode of claim 25 wherein said active upper surface is further comprised of a central planar region and a secondary sloping surface at the outer edge region.

27. The cathode of claim 26 wherein the secondary sloping surface extends transversely at an acute angle falling substantially in the range 2° to 20° relative to horizontal.

28. The cathode of claim 23 wherein the active upper surface is a curved transverse surface having an acute angle relative to horizontal which increases towards the outer edge region.

29. The cathode of claim 28 wherein the active upper surface is sloped in the primary direction at an acute angle substantially within the range 1° to 15° relative to horizontal.

30. The cathode of any one of claims 23, 26 or 28 wherein the outer edge region is bevelled or curved in the primary direction.

31. The cathode of claim 29 wherein said outer edge region is in the form of a curved surface having an acute angle which increases relative to the horizontal towards the edge.

32. An aluminum smelting cell anode having an active lower surface with at least an outer edge portion sloped in a primary direction relative to the horizontal at an angle falling substantially in the range 1° to 45° relative to horizontal, and sloped in a transverse direction which reduces the migration of bubbles in the primary direction generated along the active lower surface during use.

33. The anode of claim 32 wherein the slope of the active lower surface in the transverse direction is about 0.5° to 20° relative to horizontal.

34. The anode of claim 32 wherein said active lower surface is further comprised of at least one secondary surface sloping transversely at an angle falling substantially in the range 0.5° to 20° relative to horizontal.

35. The anode of claim 32 wherein said active lower surface is comprised of two secondary sloping surfaces each extending transversely from a central position at an angle falling substantially in the range 0.5° to 5° relative to horizontal.

36. The anode of claim 32 wherein said active lower surface further comprises a central planar region and a secondary sloping surface at an anode outer edge region, said secondary sloping surface extending transversely at an angle falling substantially in the range 2° to 20° relative to horizontal.

37. The anode of claim 36 wherein the secondary sloping surface comprises a curving transverse surface sloping in an acute angle which increases relative to the horizontal towards the anode outer edge region.

38. The anode or claim 32 wherein said active lower surface is upwardly sloped in the primary direction at an angle falling substantially within the range 1° to 15° relative to horizontal.

39. The anode of claim 36 wherein the outer edge region is bevelled or curved in the primary direction.

40. The anode of claim 39 wherein the bevelled edge is a curved surface having an acute angle which increases relative to the horizontal towards the outer edge region.

41. A plurality of anodes as defined in claim 36 suspended above and in a parallel spacial relationship to a cathode.

* * * * *